US005645169A

United States Patent [19]

Dull et al.

[11] Patent Number: 5,645,169

[45] Date of Patent: Jul. 8, 1997

[54] PACKAGE FOR USE IN THE TRANSPORT OF WATER-SOLUBLE BAGS OF AGRICULTURAL CHEMICALS IN GEL OR LIQUID FORM

[75] Inventors: Lawrence Clifford Dull, Greensboro; Larry Arnold Simmons, Winston-Salem, both of N.C.

[73] Assignee: Ciba-Geigy Corporation, Tarrytown, N.Y.

[21] Appl. No.: 367,157

[22] PCT Filed: Jun. 11, 1993

[86] PCT No.: PCT/US93/05402

§ 371 Date: Jan. 10, 1995

§ 102(e) Date: Jan. 10, 1995

[87] PCT Pub. No.: WO94/02381

PCT Pub. Date: Feb. 3, 1994

Related U.S. Application Data

[63] Continuation-in-part of Ser. No. 913,960, Jul. 17, 1992, abandoned.

[30] Foreign Application Priority Data

Jun. 11, 1993 [WO] WIPO ..... PCT/US93/05402

[51] Int. Cl.[6] ..... B65D 85/84; B65D 81/05

[52] U.S. Cl. ..... 206/589; 206/524.7; 206/576

[58] Field of Search ..... 206/461, 470, 206/471, 472, 473, 521, 524.7, 557, 564, 588, 589, 526; 383/107

[56] References Cited

U.S. PATENT DOCUMENTS

| | | | |
|---|---|---|---|
| 2,493,182 | 1/1950 | Beder . | |
| 2,554,215 | 5/1951 | Schell et al. . | |
| 2,858,224 | 10/1958 | Darrah . | |
| 2,993,590 | 7/1961 | Denton . | |
| 3,135,450 | 6/1964 | Chaplin . | |
| 3,695,989 | 10/1972 | Albert . | |
| 3,892,905 | 7/1975 | Albert . | |
| 3,913,734 | 10/1975 | Siegel . | |
| 4,020,694 | 5/1977 | Mayhew . | |
| 4,041,851 | 8/1977 | Jentsch | 383/107 X |
| 4,168,002 | 9/1979 | Crosby . | |
| 4,226,358 | 10/1980 | Ottow | 206/526 X |
| 4,296,859 | 10/1981 | McClinton . | |
| 4,467,918 | 8/1984 | Blot | 206/526 X |
| 4,501,361 | 2/1985 | Rose, Jr. . | |
| 4,724,964 | 2/1988 | Hernandez . | |
| 4,756,419 | 7/1988 | Le Bras | 206/430 |
| 4,757,898 | 7/1988 | Klein . | |
| 4,854,450 | 8/1989 | Fisher . | |
| 4,869,364 | 9/1989 | Broy . | |
| 4,892,195 | 1/1990 | Slavin et al. . | |
| 5,048,876 | 9/1991 | Wallskog . | |
| 5,394,990 | 3/1995 | Edwards et al. | 206/524.7 |
| 5,405,013 | 4/1995 | Gee | 206/524.7 X |

FOREIGN PATENT DOCUMENTS

| | | | |
|---|---|---|---|
| 0341532 | 11/1989 | European Pat. Off. . | |
| 0347219 | 12/1989 | European Pat. Off. . | |
| 0347220 | 12/1989 | European Pat. Off. . | |
| 2557540 | 6/1977 | Germany . | |
| 8529760 | 12/1985 | Germany . | |
| 0922317 | 3/1963 | United Kingdom . | |
| WO9105714 | 5/1991 | WIPO | 206/529.7 |
| WO93008091 | 4/1993 | WIPO | 206/524.7 |

*Primary Examiner*—Bryon P. Gehman
*Attorney, Agent, or Firm*—Edward McC. Roberts; Marla J. Mathias; William A. Teoli, Jr.

[57] ABSTRACT

A package containing water-soluble bags filled with agricultural chemicals in gel or liquid form facilitates the transport of the bags in a manner which prevents the breakage thereof. The package includes compartments for holding the bags. The walls and base of these compartments contain raised and unraised portions in a pattern such that a baffling effect is created to damper transport shock waves in the gel or liquid bag. These and other features result in the transmission of dynamic shock loads in the package in a manner which prevents such shock loads from breaking the fragile water-soluble bags during transport.

12 Claims, 14 Drawing Sheets

PACKAGE FOR USE IN THE TRANSPORT OF WATER-SOLUBLE BAGS OF AGRICULTURAL CHEMICALS IN GEL OR LIQUID FORM

This is a 371 of PCT/U.S. Ser. No. 93/05402, filed Jun. 11, 1993, which is a continuation-in-part of Ser. No. 07/913,960, filed Jul. 17, 1992, now abandoned.

BACKGROUND OF THE INVENTION

1. Field of the Invention

The present invention relates to the storage and transport of individual doses of chemicals. In particular, the present invention relates to a package containing individual portions of chemicals in the form of water-soluble bags containing agricultural chemicals in gel or liquid form.

2. Description of the Related Art

Water-soluble bags containing agricultural chemicals in gel or liquid form have just recently been developed and put into practical use. These water-soluble bags may be thrown into a water tank of a spray system whereupon the bags dissolve and the chemicals contained therein are dispersed into the water supply. Thus, there is no need to dispose of the packaging of the chemicals. U.S. Pat. No. 5,080,226 to Hodakowski et al. discloses a water-soluble bag of polyvinylalcohol containing agricultural chemicals in gel form. These bags are extremely susceptible to problems of leakage owing to the fact that small pin-holes may be formed in the polyvinylalcohol during its manufacture by a casting process. GB 2 244 258 teaches laminating layers of the polyvinylalcohol so as to reduce the chance that pin-holes in the individual layers of the laminate will allow leakage of the chemicals.

Nonetheless, these bags remain extremely fragile and susceptible to outright breakage during the transport thereof.

SUMMARY OF THE INVENTION

An object of the present invention is to provide a package having a simple structure which facilitates the transport of bulk material, particularly agricultural chemicals, in a leak-free way.

Another object of the present invention is to provide a package which is particularly adapted to transport fragile water-soluble bags containing agriculture chemicals in gel or liquid form. To achieve this object, the packaged product has characteristics which transmit dynamic shock loads in order to prevent the breakage of the fragile water-soluble bags during transport.

Finally, another object of the present invention is to provide a package for use in the transport of chemicals which is very convenient for the end user.

To achieve this object, the package has "waffling" in the compartments holding the gel or liquid bags with raised portions along the sides and walls. The package also has features particular to each embodiment such as the dimensioning of the water-soluble bags relative to the receptacle openings in which they are fitted such that the length and width of the water-soluble bags are greater than those of the receptacle openings, the side and central sub-compartments of the second embodiment. and the particular design of the fourth embodiment such as the PVC material and the provision of the bottom walls of the receptacles in fixed contact with the underlying base sheet, are together responsible for the transmission of dynamic shock loads, commonly experienced during transport, in a manner which prevents breakage of the fragile water-soluble bags.

BRIEF DESCRIPTION OF THE DRAWINGS

These and other objects, features and advantages of the present invention will become apparent to those of ordinary skill in the art from the following description of the preferred embodiments thereof made with reference to the accompanying drawings, in which.

DESCRIPTION OF THE PREFERRED EMBODIMENTS

Figure 1:
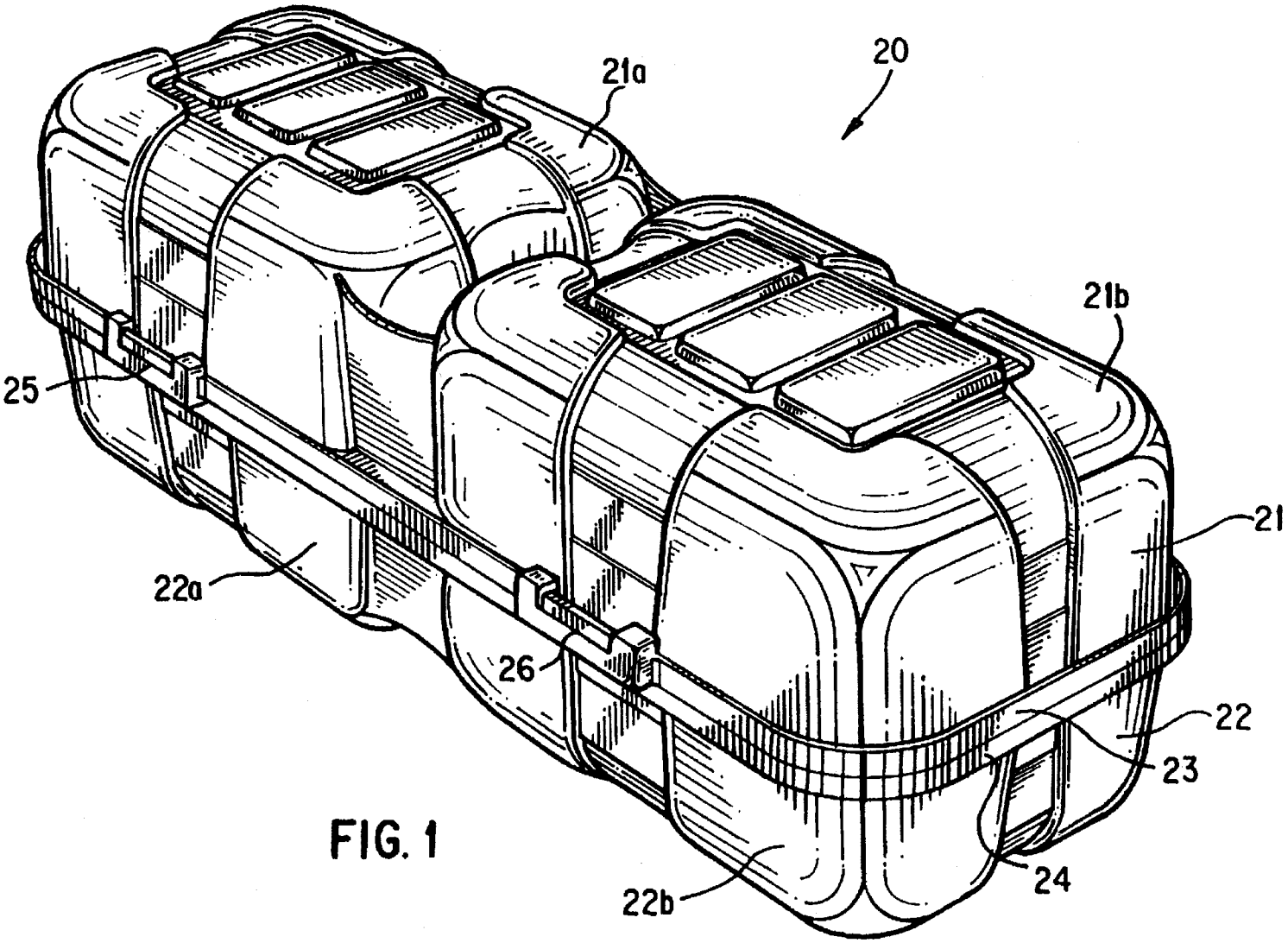
FIG. 1 is a front, overhead perspective view of a gel bag transport package in accordance with the invention, the package being shown folded and in closed position.
Figure 2:
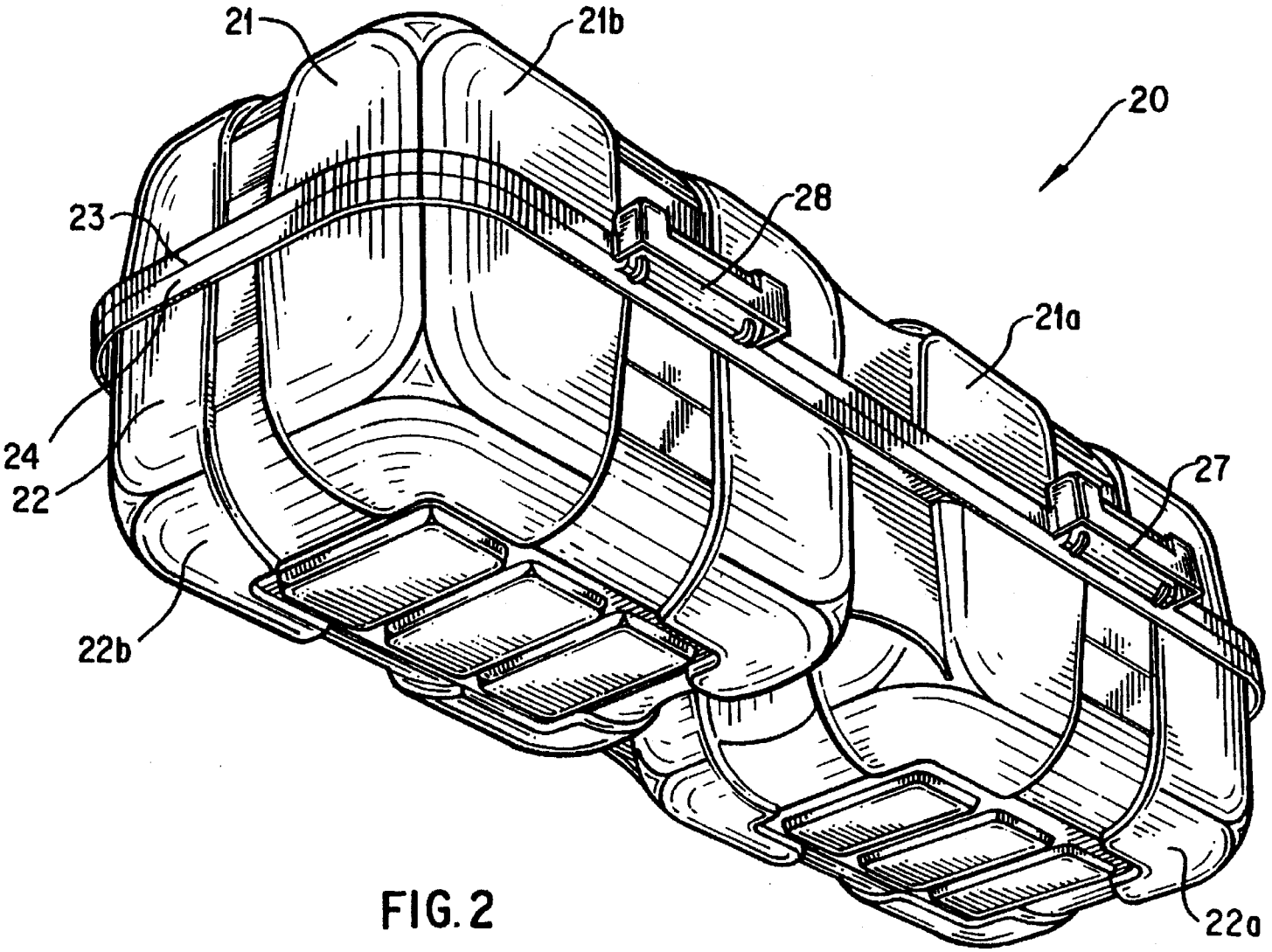
FIG. 2 is a rear, underside perspective view thereof.

Reference is first made to FIGS. 1 and 2 wherein a gel bag transport package, generally indicated at 20, is depicted. Gel bag transport package 20 contains two identical halves. specifically first half 21 and second half 22. shown in the closed position. First half 21 defines two compartments, **21*a* and 21*b*, which are bordered by first perimeter edge rim 23. Similarly, second half 22 defines two compartments. 22*a* and 22*b*, which are bordered by second perimeter edge rim 23. In the closed position, first and second halves 21 and 22 are joined at first and second perimeter edge rims 23 and 24 and interconnected at snap joints 25–28**.

Figure 4:
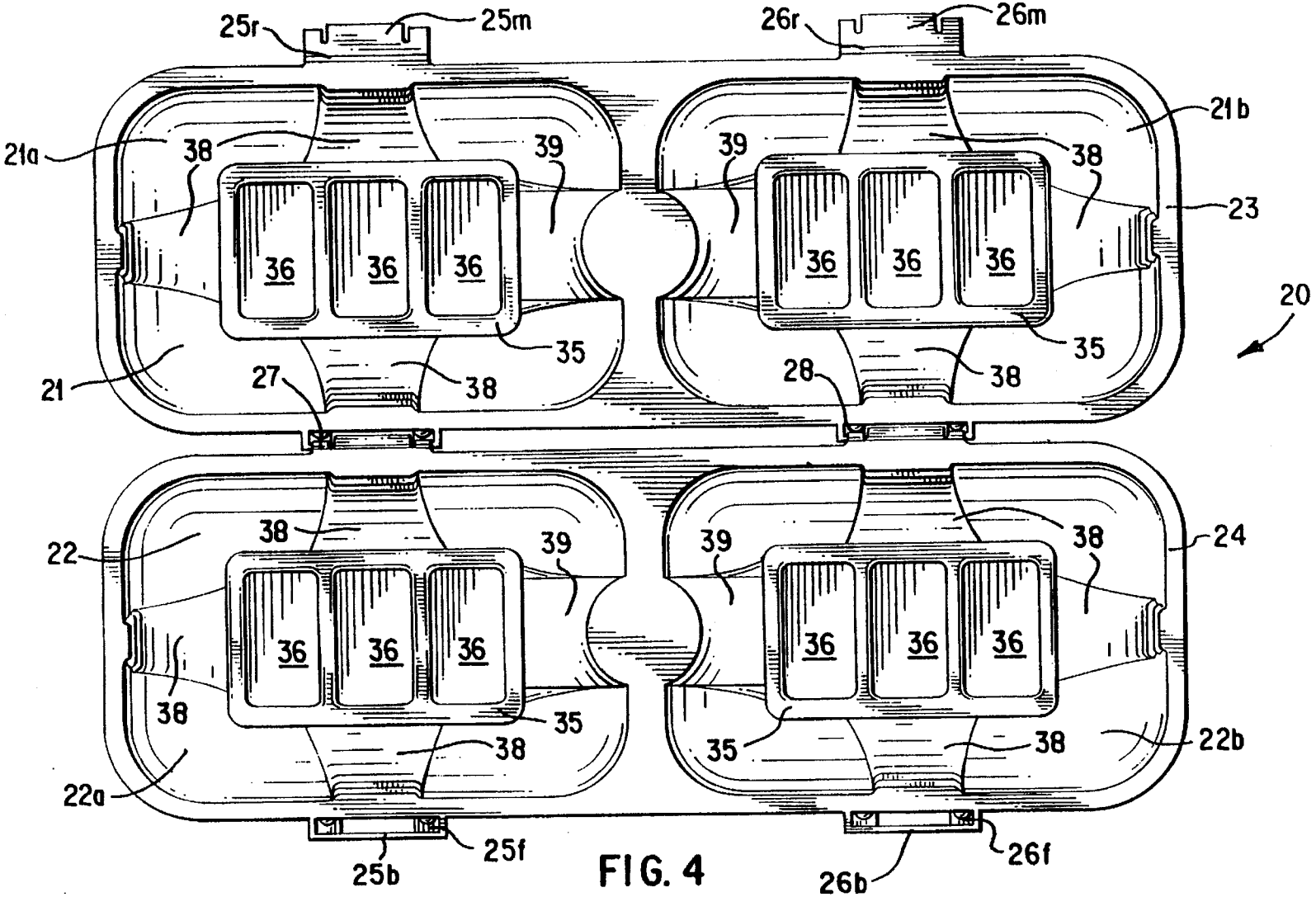
FIG. 4 is a top plan view showing the interior of the gel bag transport package illustrated in FIG. 1, the package being shown open in flat position.

FIG. 4 shows gel bag transport package 20 in the open, unfolded position without gel bags. Snap joints 25 and 26 have been released into male members **25*m* and 26*m* on first half 21, and female members 25*f* and 26*f* on second half 22. When male members 25*m* and 26*m* are inserted respectively into female members 25***f* ad 26*g*, ridges 25*r* and 26*r* in male members 25*m* and 26*m* are caught by the edge of bars 25*b* and 26*b* of female members 25*f* and 26*f* to secure snaps joints 25 and 26 together until such time as they are released by the user. Similarly, snap joints 27 and 28 can be similarly separated such that identical halves 21 and 22 are completely separate, for instance as is later shown in FIG. 8.

Figure 5:
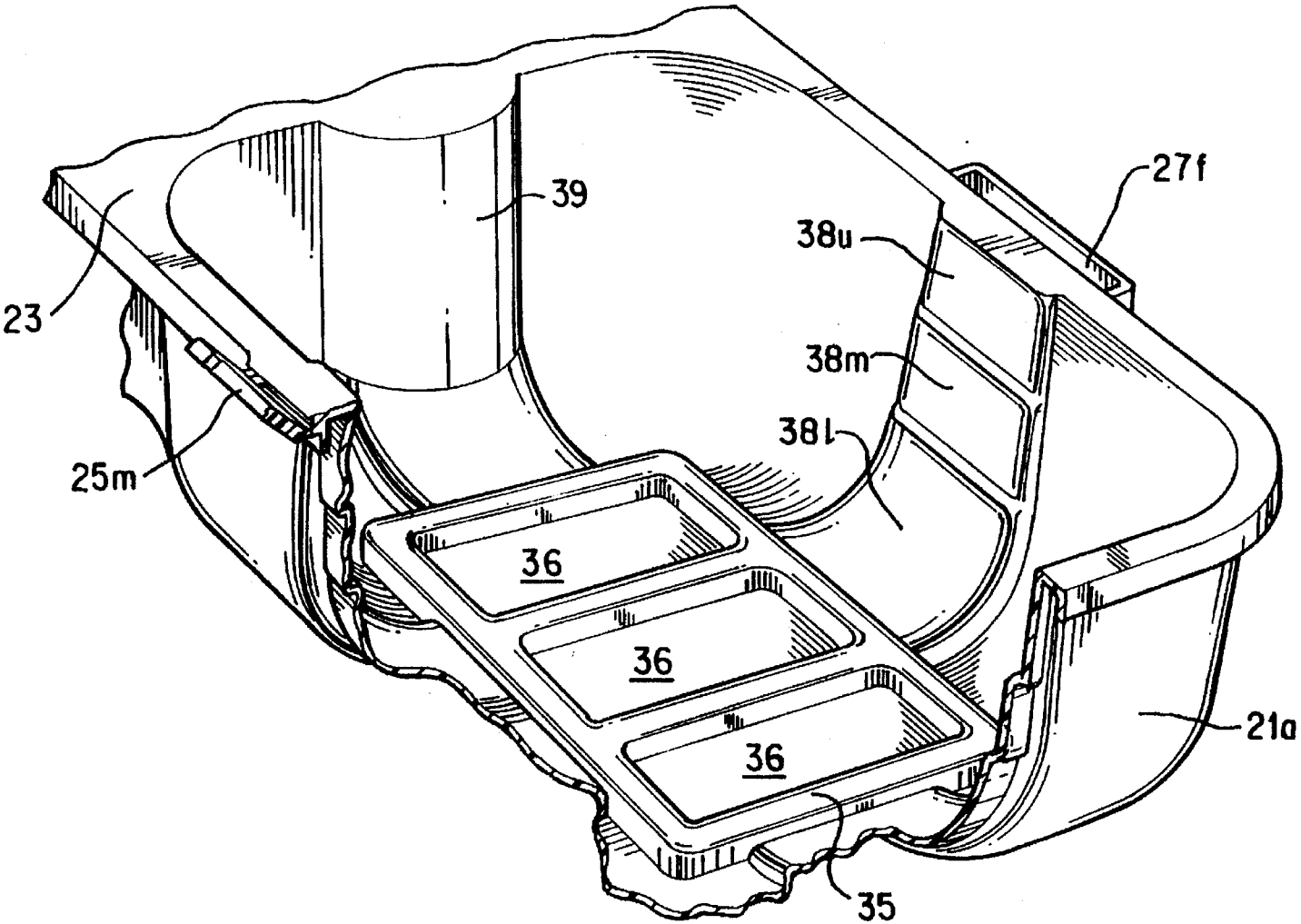
FIG. 5 is a broken away sectional view of the gel bag transport package in the open position of FIG. 4.

FIG. 5 shows a cutaway sectional view of compartment 21*a*. In FIGS. 4 and 5, the interior surface of gel bag transport package 20 can be seen. The base portion of the interior surface of compartments 21*a*, 21*b*, 22*a* and 22*b* include a "waffling" design. Specifically, in each compartment, raised base frame 35 defines three unraised base surface portions 36. Additionally, each defined compartment has four raised side surfaces, specifically three raised side portions 38 and one central raised side portion 39. Each raised side portion 38 has three parts, the lower portion 38*l*, the middle portion 38*m* and the upper portion 38*u*. Lower portion 38*l* extends farthest into the compartment and upper portion 38*u* extends the shallowest, creating a pyrimidal effect. Central raised side portion 39 juts cylindrically into the compartment.

Gel bag transport package 20 can be made of any polymeric material such as polyvinylchloride or polypropylene, and preferably a lightweight plastic such as recycled polyethylene. Gel bag transport package 20 can be made according to any known manufacturing process, such as a deep drawing process, but one preferred technique is injection molding. Other materials and production techniques are exemplified in embodiments discussed below.

Figure 6:
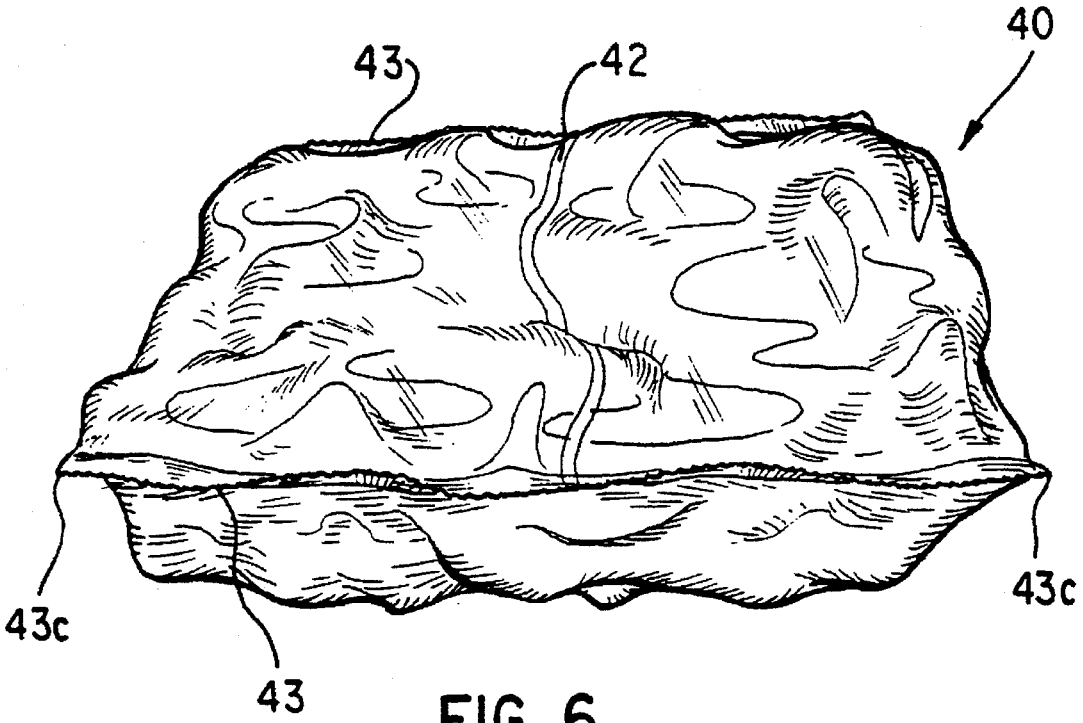
FIG. 6 is a perspective view of a gel bag.
Figure 7:
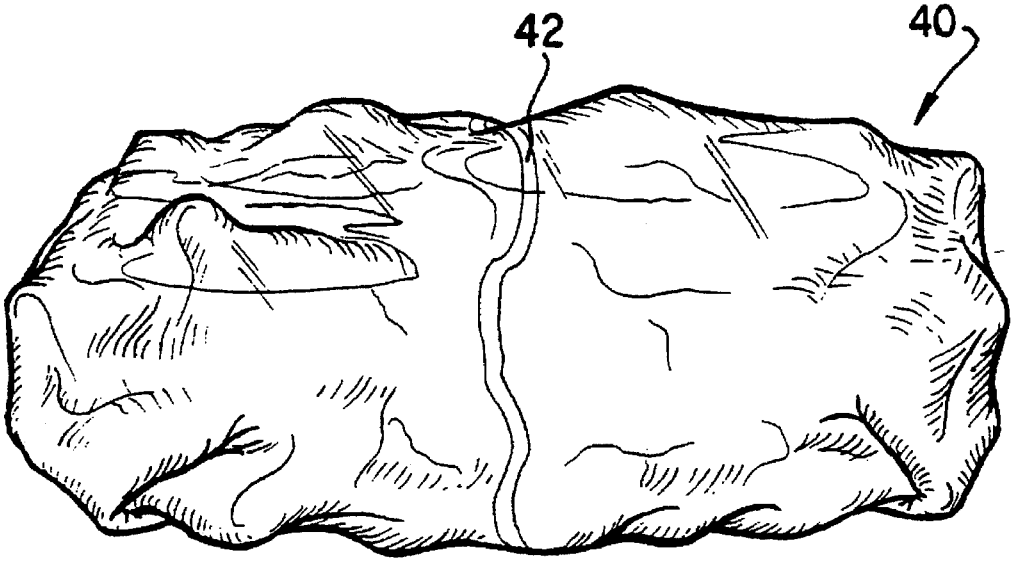
FIG. 7 is a perspective view of the gel bag of FIG. 6 in a folded position.

FIGS. 6 and 7 illustrate a typical gel bag 40. Gel bag 40 includes water-soluble polymeric film, such as polyvinylalcohol, surrounding a gel formulation. typically containing a chemical such as agricultural pesticides, herbicides, fertilizer, fungicides, insecticides and the like. The effectiveness of transport package 20 in reducing bag breakage is so great, it is to be understood that the gel in gel bag 40 may also have a viscosity low enough to be within the liquid range. Gel bag 40 has a vertical seam 42 and two side seams 43. For use in gel bag transport package 20, side seams 43 are turned underneath as shown in FIG. 7, and the side seam corners 43*c* are then also turned under.

Figure 8:
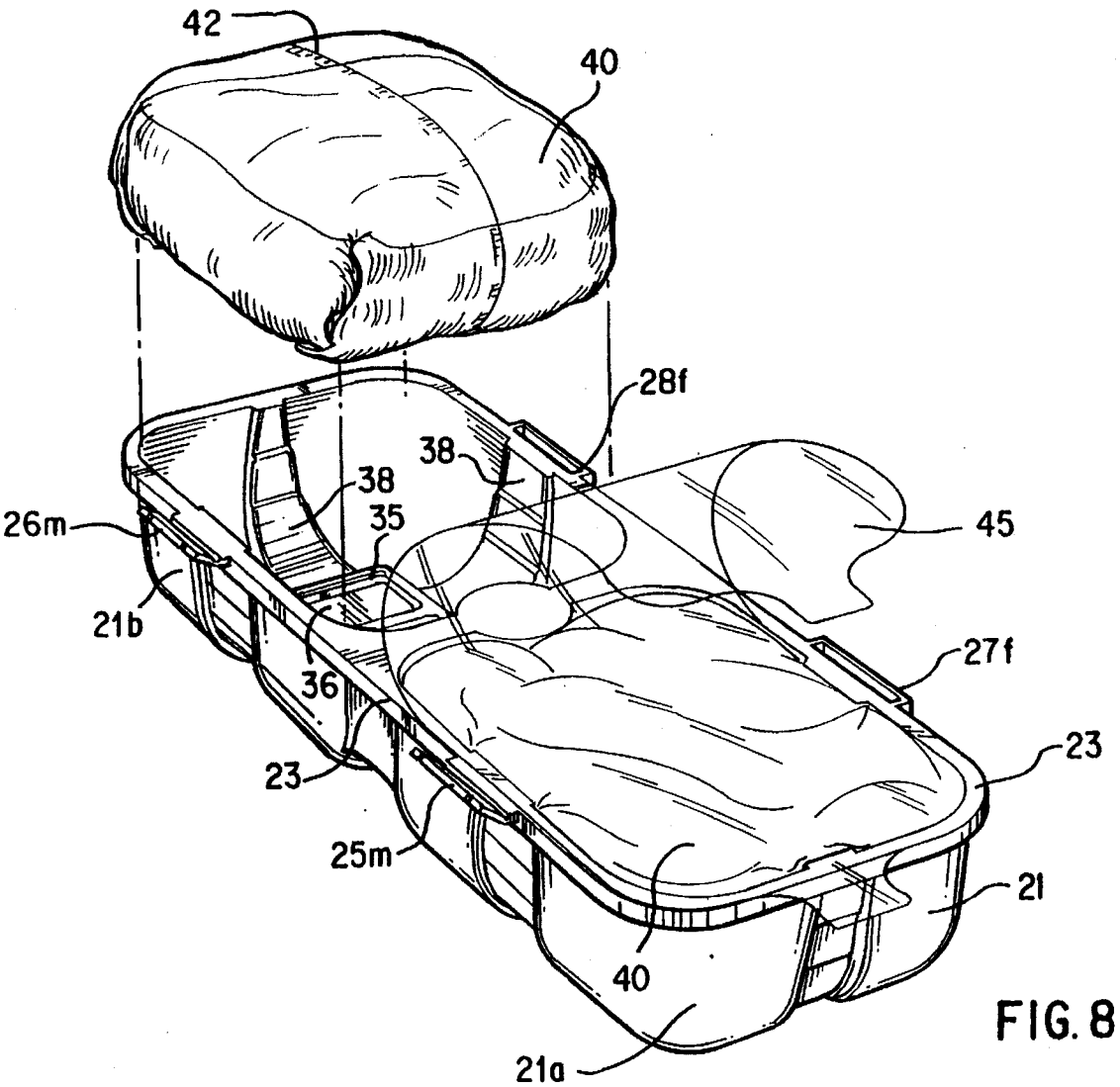
FIG. 8 is perspective view of half of the gel bag transport package in the open position of FIG. 4 and the placement of gel bags therein.

As demonstrated in FIG. 8. gel bag 40 is then placed within one half section of gel bag transport package 20. in this case first half 21. Since side seams 43 have been tucked under gel bag 40, the side seams are not in direct contact with the side walls of compartments 21*a* or 21*b*. In order for gel bag 40 to maintain this shape. the length and width of gel bag 40 should be greater than the length and width of compartments 21*a* and 21*b*. Gel bags 40 will thus need to be tucked into compartments 21*a* and 21*b*. This placing of gel bags 40 will reduce stress on side seams 43 and thus reduce the chance for breakage of gel bags 40 during transport.

Once two gel bags 40 are placed in compartments 21*a* and 22*b*, a film cover layer 45 is placed thereon and heat sealed along first perimeter edge rim 23. Film cover layer may be formed of any lightweight polymeric film but clear polyester is particularly preferred.

Similarly, two more gel bags are also placed in the other half of gel bag transport package 20 and sealed therein, and then halves 21 and 22 are joined together and removably locked in place with snap joints 25–28. Gel bag transport package 20 and the four gel bags 40 contained therein are then ready for safe transport to the consumer destination.

Figure 3:
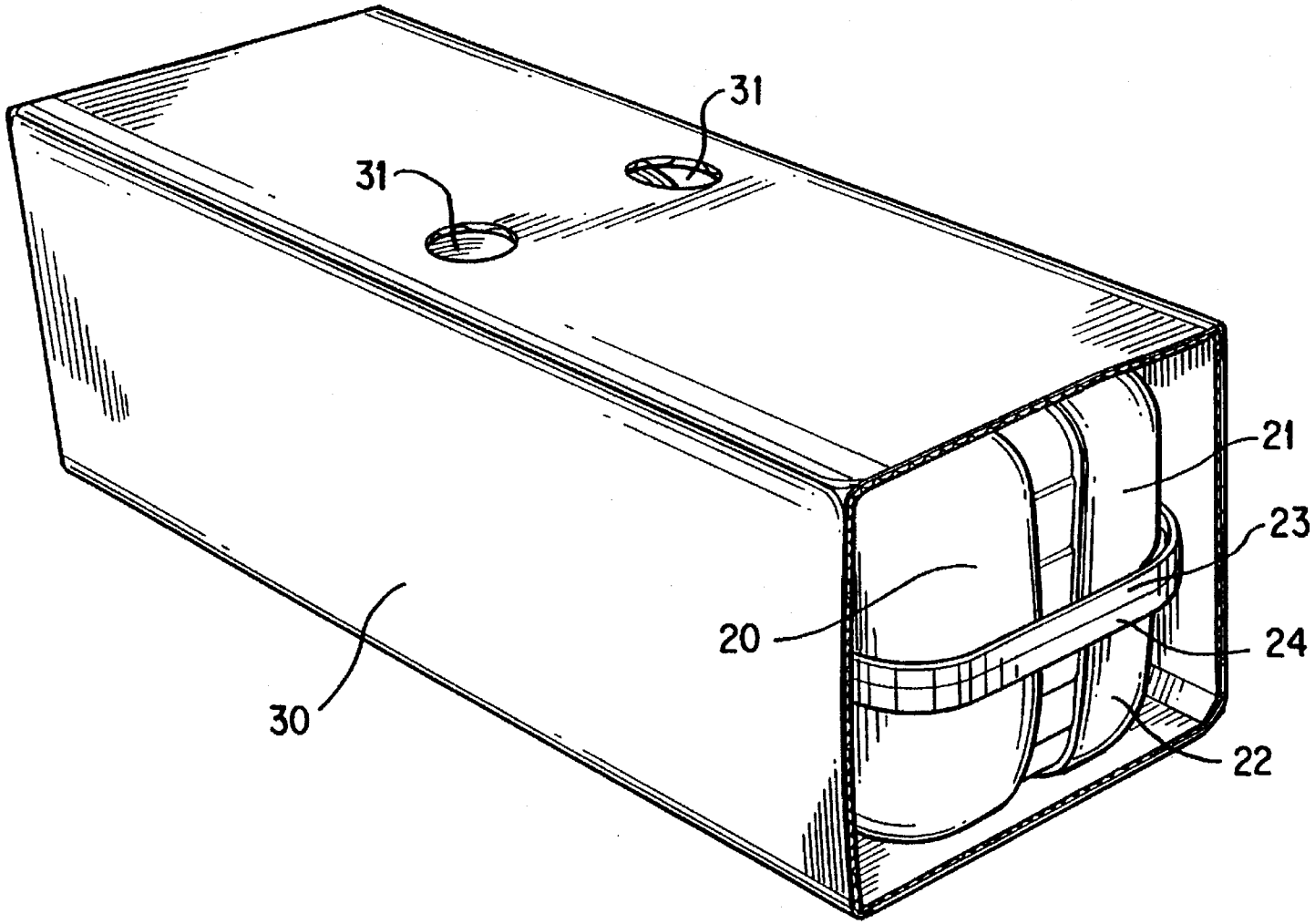
FIG. 3 is a front, overhead perspective view of the gel bag transport package illustrated in FIG. 1. further enclosed within a carrying sleeve.

An outer sleeve 30 shown in FIG. 3 may optionally be provided for convenience of the user. If so, gel bag transport package 20 is slideably placed within outer sleeve 30, and can similarly be easily removed. Outer sleeve 30 includes thumb and index finger grip holes 31 such that outer sleeve 30 and gel bag transport package 20 contained therein may be carried using the thumb and index finger of one hand. Outer sleeve 30 may be made of any lightweight material, preferably recyclable cardboard or corrugated board.

Figure 9:
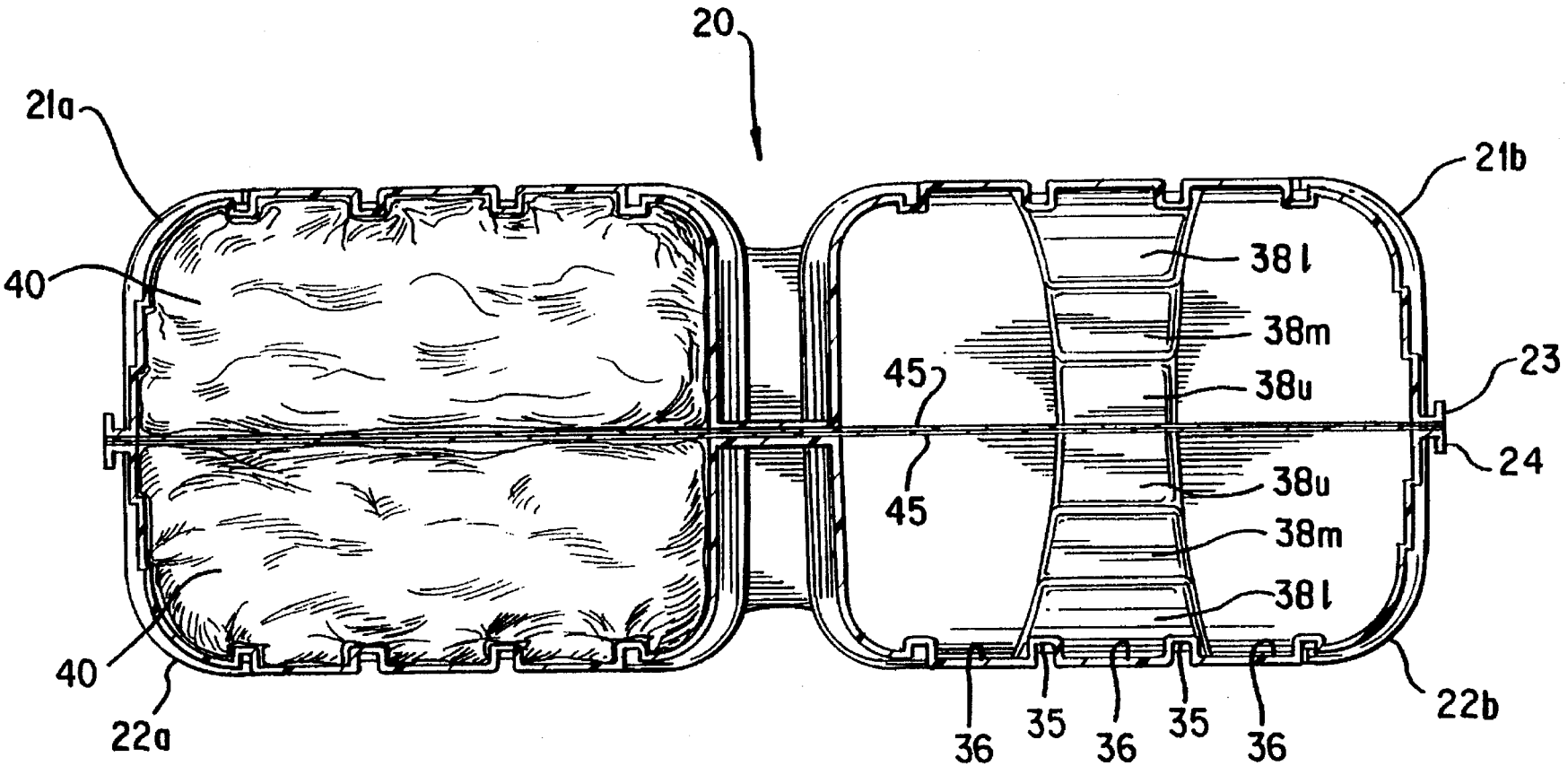
FIG. 9 is a sectional view of the gel bag transport package containing two gel bags therein.

The benefits of gel bag transport package 20 for ensuring safe delivery. of gel bags 40 are as follows. As previously noted, the length and width of compartments 21*a*, 21*b*, 22*a* and 22*b* are such that side seams 43 of gel bags 40 are tucked underneath and subject to less stress from friction against the compartment side walls. However, the presence of the "waffling" designs on the base and side walls of the compartment is particularly important in deflecting shock waves generated in the gel during transport. As seen in FIG. 9, the present of raised base frame 35, unraised base surface portions 36, raised side portions 38 and central raised side portion 39 creates a pattern of baffles jutting into the gel bag which acts to damp the gel bag transport waves, just as baffles are used in so-called "waveless" waterbeds. The damping of the shock waves serves to reduce the stress placed on the fragile gel bag water-soluble outer film, and increase the chance that the gel bags will arrive intact to the consumer.

Moreover the effectiveness of gel bag transport package 20 in damping transport shock waves is so great that additional amounts of air may be introduced into gel bag 40. Such air might increase unstability in the transport of bags without the damping benefits of the raised portions in each compartment. Air is desirable in gel bags because such bags tend to float when introduced by the farmer user into the water tank system, and are thereby more likely to rapidly dissolve than bags without air which sink to the "dead" spot of the water tank.

Figure 10:
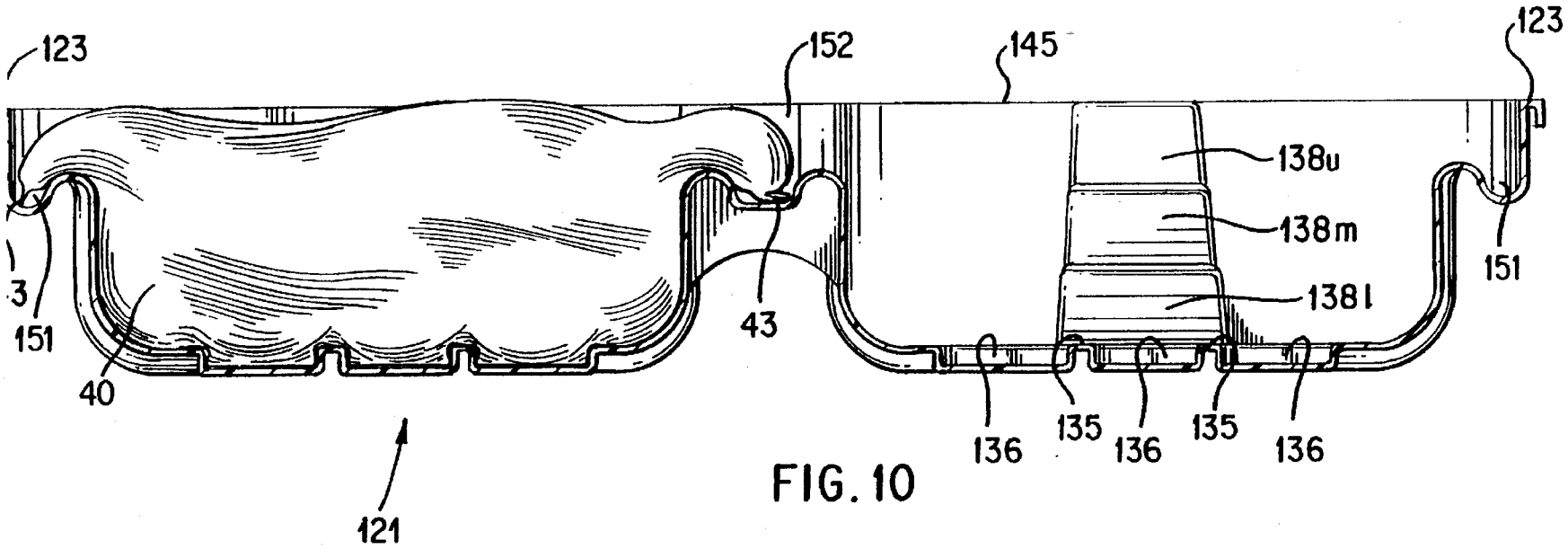
FIG. 10 is a sectional view of one half of a gel bag transport package in accordance with a second embodiment of the invention, with one gel bag contained therein.

A second embodiment of the invention is illustrated in FIG. 10. First half 121 is similar to its first embodiment counterpart, first half 21, in that it contains first perimeter edge rim 123, film cover layer 145 attached thereto, raised side portions 138, raised base frame 135 and unraised base surface portions 136. However, rather than each compartment having a length and width smaller than the length and width of gel bag 40 such that side seams 43 are tucked under gel bag 40, instead first half 12I includes side sub-compartments 151 and central sub-compartment 152. Side seams 43 are then placed in side sub-compartments 151 and central sub-compartment, again away from the friction of the compartment walls.

Figure 11:
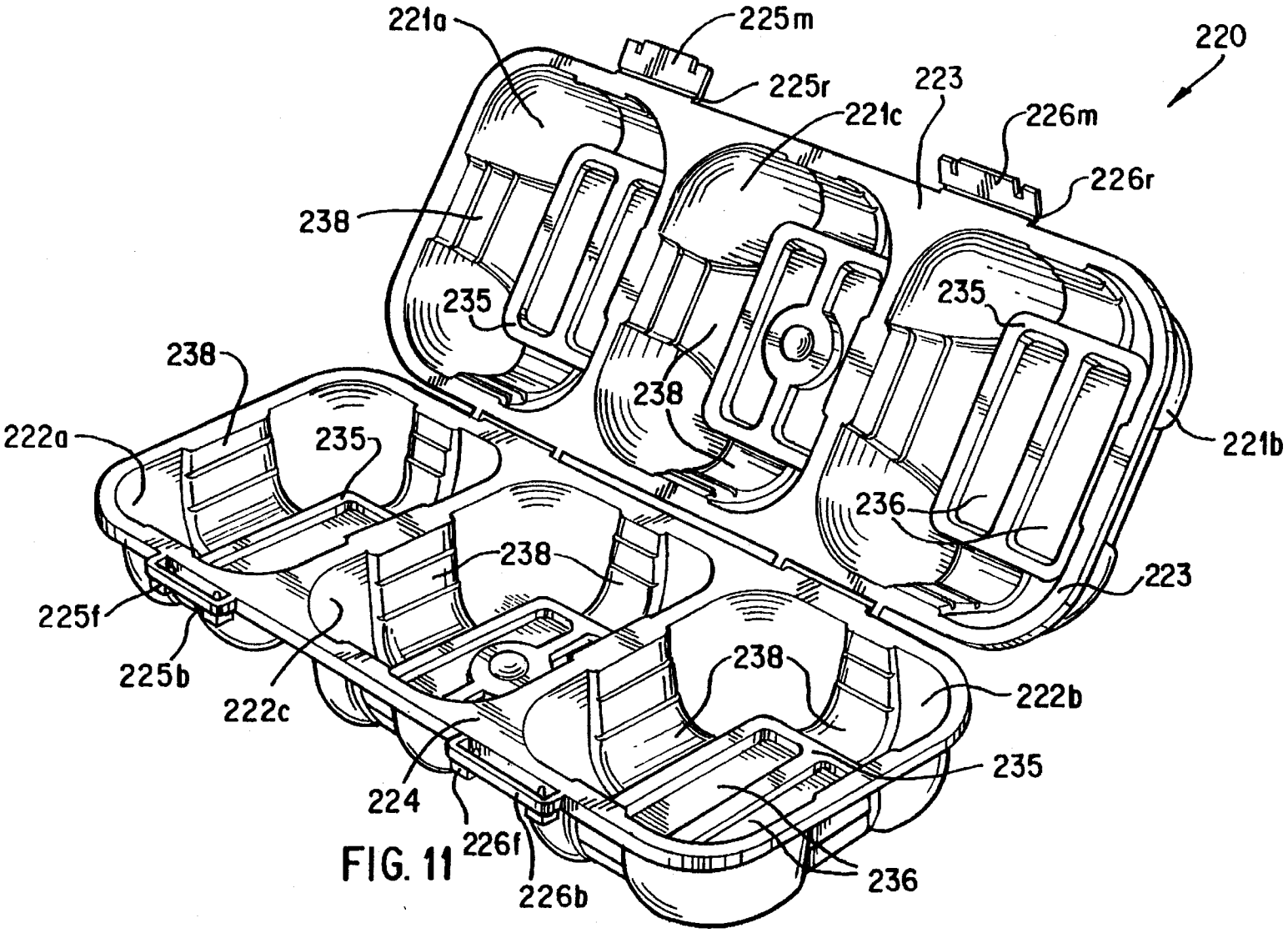
FIG. 11 is a prespective view of a gel bag transport package in accordance with a third embodiment of the invention, the package being shown open.

A third embodiment of the invention is illustrated in FIG. 11. Gel bag transport package 220 is similar to gel bag transport package 20, except each half 221 and 222 contains three compartments, 221*a*, 221*b* and 221*c*, and 222*a*, 222*b* and 222*c*, respectively. Also similar to the first embodiment, gel bag transport package 220 includes first and second perimeter edge rims 223 and 224, and snap joints 225 through 228 with their respective female and male members. The "waffling" design of the six compartments varies somewhat from the first embodiment. Raised base 235 defines only two unraised base surface portions 236 instead of three as in the first embodiment. Also, the sides of the compartments contain four raised side portions 238 and no central raised side portion equivalent to central side portion 39 in the first embodiment. Gel bag transport package 220 is particularly suited for transporting six smaller gel bags 40.

Figure 12:
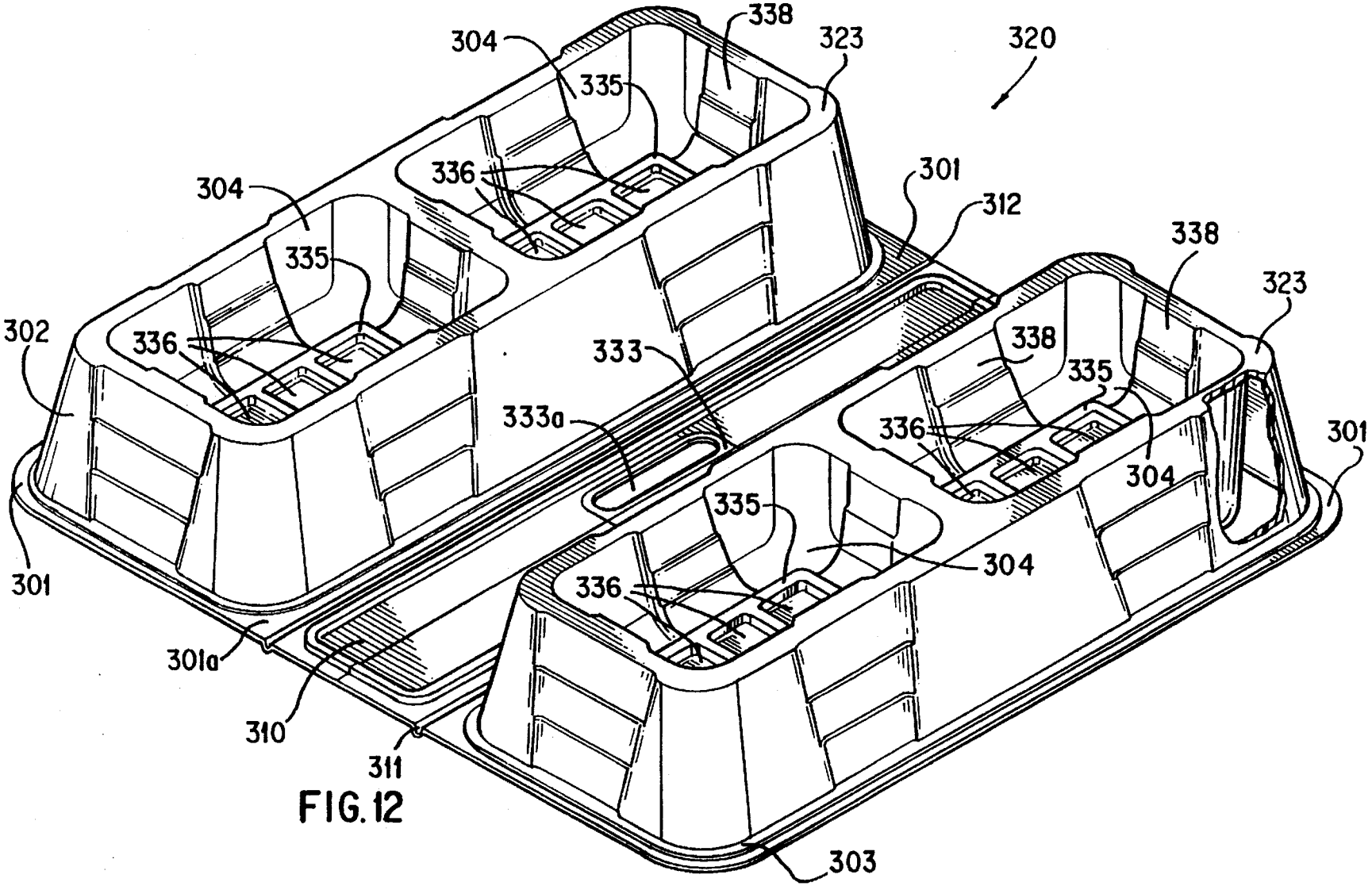
FIG. 12 is a perspective view, partially broken-away, of constituent components constituting the package in accordance with a fourth embodiment of the invention.

A fourth embodiment of the invention is illustrated in FIGS. 12–15. Referring to FIG. 12, gel bag transport package 320 includes a base sheet 301, preferably of PVC (polyvinylchloride), and two thermoformed sheets 302. 303, also preferably of PVC, which are discrete from the base sheet 301. These thermoformed sheets 302, 303 are disposed on the same major surface 301*a* of the base sheet in a juxtaposed relation. Each of the thermoformed sheets 302, 3033 is fixed to the base sheet 301, preferably by a thermal welding technique known per se. The thermoformed sheets 302, 303 each define at least one receptacle generally designated by reference numeral 304. In the illustrated embodiment, each of the thermoformed sheets 302, 303 define two receptacles 304.

Figure 13:
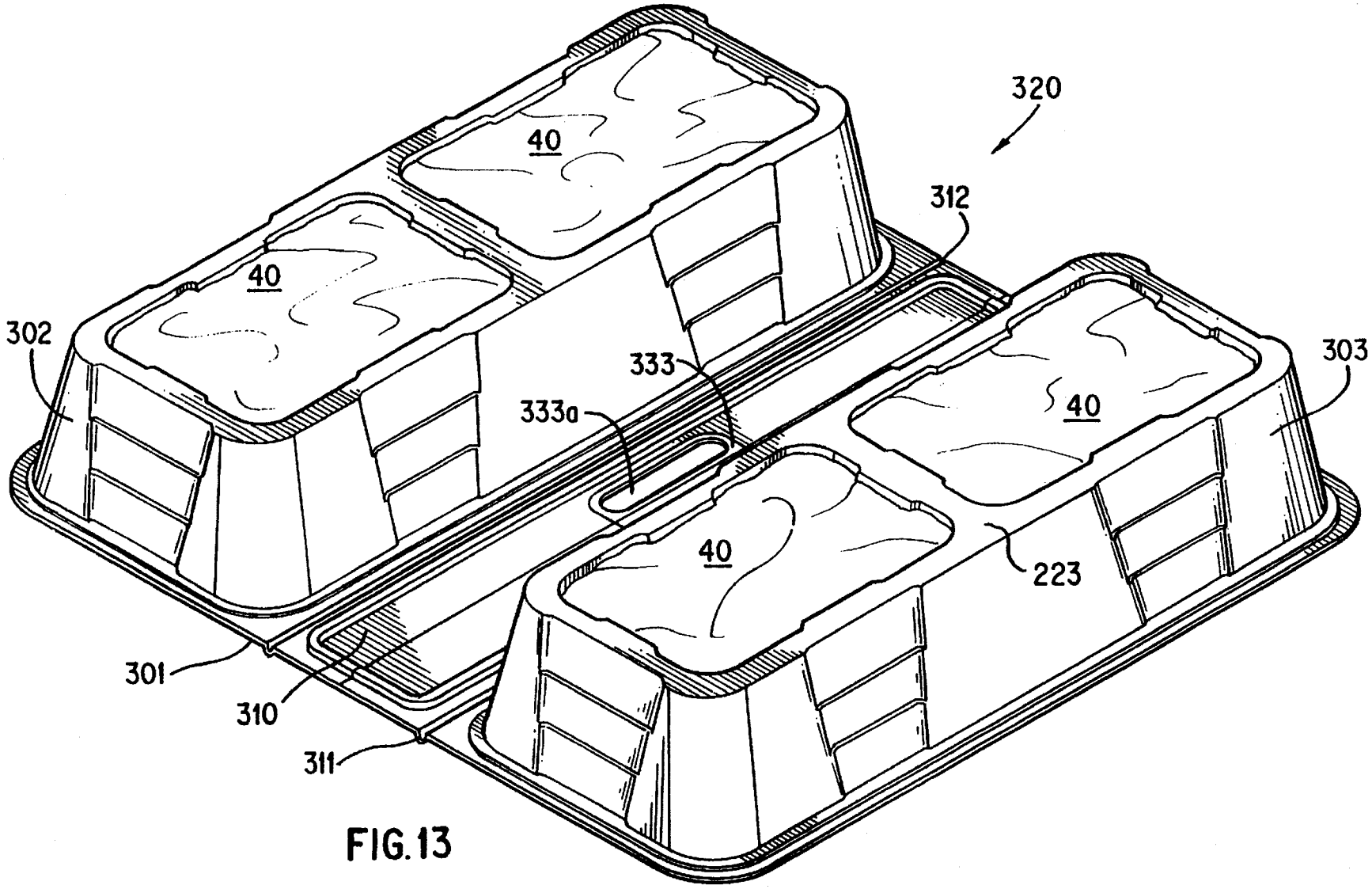
FIG. 13 is a similar perspective view but showing water-soluble bags disposed in the receptacle openings of the package depicted in FIG. 12.
Figure 14:
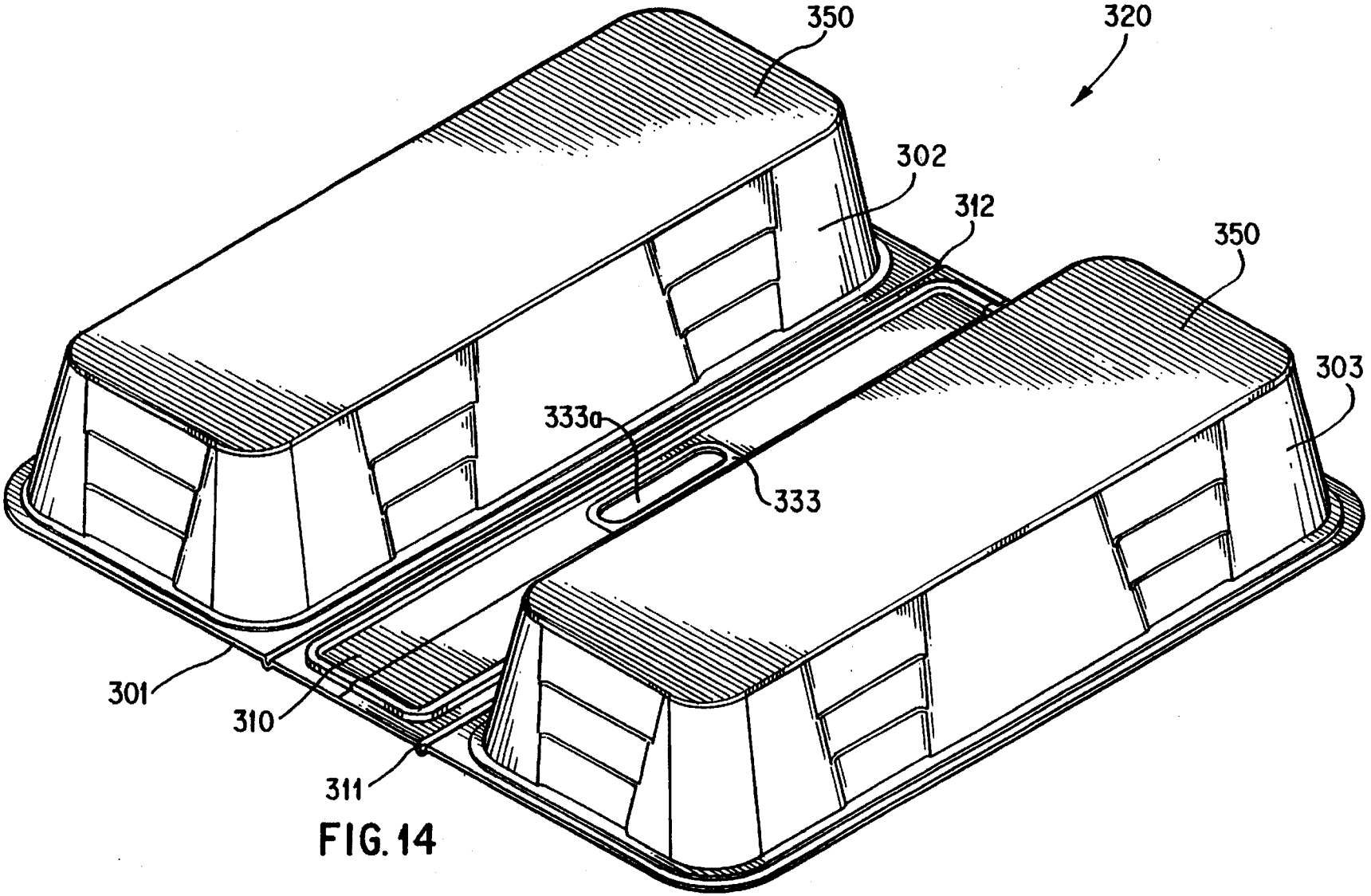
FIG. 14 is a similar perspective view but of the final packaged product depicted in FIG. 12 having removable lids covering the receptacle openings so as to retain the water-soluble bags therein.

The receptacles 304 are tray-like, meaning that they have a receptacle opening clearly shown in FIG. 12, a perimeter edge nm 323, a base defining the bottom of the receptacle opening including raised base frame 335 and unraised base surface portions 336, and side wall areas including raised side portions 338. As shown in FIG. 13, gel bags 40 are placed in the receptacle openings. Then, as shown in FIG. 14, a lid 350 is disposed over each of the receptacle openings so as to cover the same and retain the gel bags 40 therein. The lid 350 can be heat-sealed to the rim 223 of the receptacles. Although a single lid is shown in FIG. 14 as covering the receptacles of each respective thermoformed sheet 302 or 303, obviously individual lids may be provided for each of the receptacles 304, respectively.

Referring again to FIGS. 12–14, the thermoformed sheets 302, 303 are spaced from one another to sides of a central region of the base sheet 301. The central region is generally designated by reference numeral 310. The base sheet is scored at the central region 310 so as to allow the base sheet to be folded at the central region to allow the package to assume a compact configuration as shown in FIG. 15 and described in more detail below.

Specifically, the base sheet 301 has two parallel scores 311, 312 extending along the sides of the central region 310 of the base sheet 301, respectively. These scores 311, 312 are shown as grooves in the base sheet 301 of the present invention, but obviously the scores can take various other forms as long as they provide a hinge about which the package can be folded.

Figure 15:
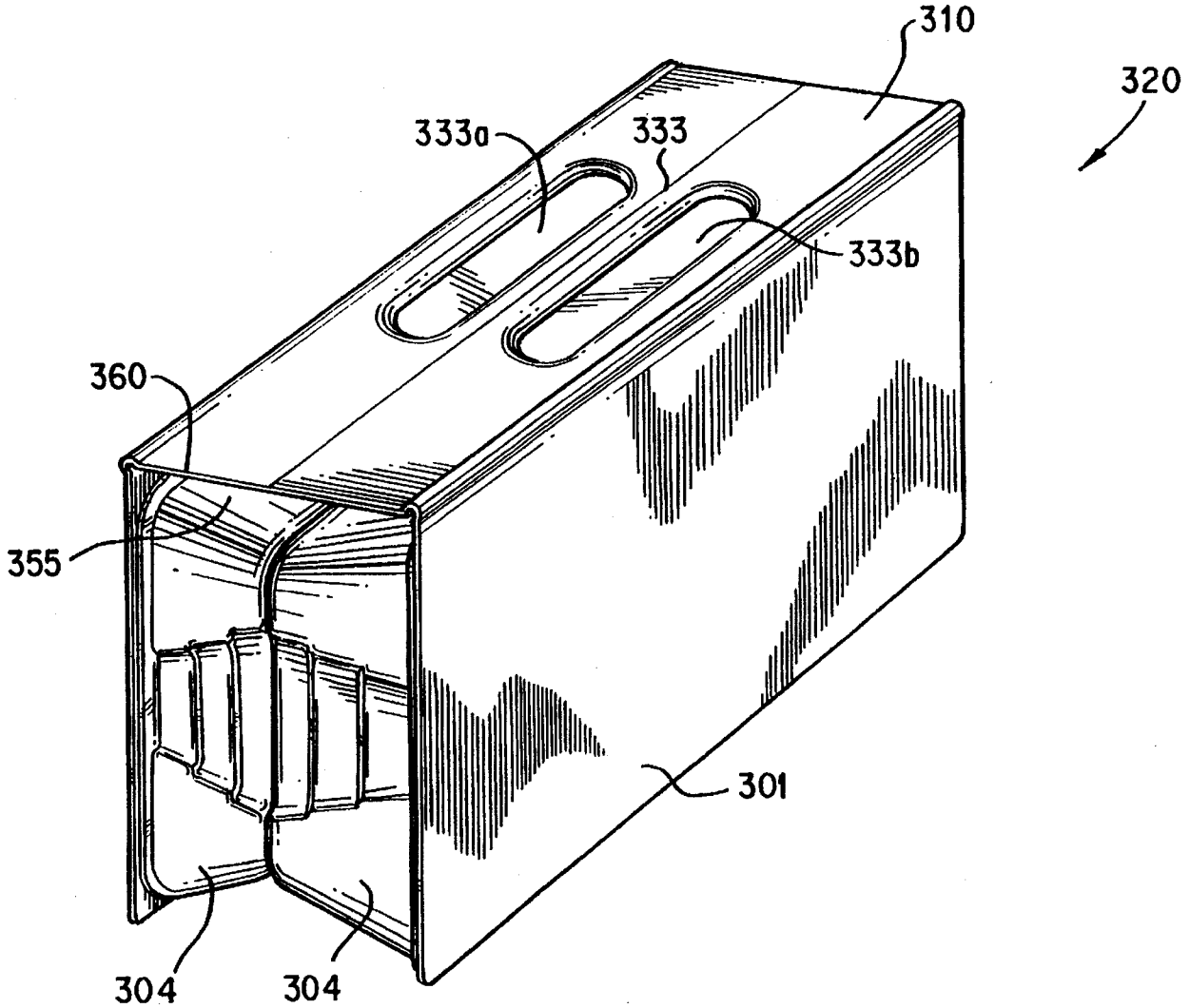
FIG. 15 is a perspective view of the packaged product depicted in FIG. 12 in its compact transport configuration.

As best shown in FIG. 15, the receptacles 304 of the respective thermoformed sheets 302, 303 are brought face-to-face when the base sheet 301 is folded along the parallel scores 311, 312, whereby the package assumes a compact configuration.

The base sheet 301 also has a handle 333 at the central region 310 thereof. The handle 333 allows the package to be carried when in the compact configuration shown in FIG. 15. Specifically, the base sheet defines two spaced apart openings 333*a*, 333*b* through the central region 310 thereof. A portion of the base sheet extends between the openings 333*a*, 333*b* so as to constitute a handle which can be gripped by one's hand.

It should be noted that when the package is in its compact transport configuration shown in FIG. 15, the receptacles 304 do not prevent one's hand from being inserted through the openings 333*a*, 333*b*. This is because the receptacles 304, as shown in the figures, each have an outer configuration which tapers from the base sheet 301 to the rim 223 thereof. Thus, when the package is in the compact configuration shown in FIG. 15, a space 355 is left between the side walls of the receptacles 304 and the central region 310 of the base sheet. This space 355 can be reliably maintained by providing a rim 360 which will abut lower portions of the side wails of the receptacles 304 and prevent a collapsing of the central region into flush contact with the side walls of the receptacles 304.

As shown in the broken-away portion of FIG. 12, the bottom wall of each of the receptacles 304 is secured to the base sheet 301 by thermal welding, for example. The present inventors have found that for the lightweight PVC which is used as the material of the thermoformed sheets 302, 303, it is important that the bottom wall of the receptacle 304 contact the underlying base sheet 301 in order that dynamic shocks occurring during transport are transmitted throughout the package in a manner which will prevent the breakage of the water-soluble bags 40 which have been tucked into the receptacle openings. It would normally be expected that a shock-absorbing capability would be provided if the bottom wall of the receptacle were suspended above the underlying base sheet 301 of the package. However the present inventors have found that this is not the case at all and in fact breakage of the fragile water-soluble bags 40 of material, such as polyvinylalcohol, occurs more readily when the bottom wall of the receptacle in which the bag is tucked is spaced above the underlying base sheet 301.

Thus, it is seen that the features described above, particularly the "waffling" of the compartments with raised portions along the sides and walls, and also the particular features of each embodiments such as the dimensioning of the water-soluble bags relative to the receptacle openings in which they are fitted such that the length and width of the water-soluble bags are greater than those of the receptacle openings, the side and central sub-compartments of the second embodiment, and the particular design of the fourth embodiment such as the PVC material and the provision of the bottom walls of the receptacles in fixed contact with the underlying base sheet, are together responsible for the transmission of dynamic shock loads. commonly experienced during transport, in a manner which prevents breakage of the fragile water-soluble bags.

Although the present invention has been described above in connection with a preferred embodiment thereof, various changes and modifications will become apparent to those of ordinary skill in the art. Therefore, such changes and modifications are intended to be within the true spirit and scope of the present invention as defined by the appended claims.

What is claimed is:

1. A package for transport of a water-soluble film bag having two edge seams and containing gel or liquid, comprising a base and four side walls defining a compartment, the edge of said side walls having a perimeter rim which defines an opening for receiving a water-soluble film bag within the compartment, wherein the base contains a raised base frame including a plurality of unraised base, surface portions and the four side walls each have a centrally disposed raised side surface portion which extends from the perimeter rim to the raised base frame such that said raised base frame and said raised side surface portions are capable of deflecting shock waves generated in the bag during transport thereof.

2. The package of claim 1, wherein the width and length of the base is smaller than the length and width of the bag to be transported such that the bag may be disposed with the package such that the edge seams are folded underneath the bag.

3. The package of claim 1, wherein the package further includes two adjoining side sub-compartments for receiving the edge seams of the bag.

4. The package of claim 1, wherein the package is made of a polymeric material selected from the group consisting of polyvinylchloride polypropylene and polyethylene.

5. The package of claim 4, wherein the polymeric material is injection-molded polyethylene.

6. A gel or liquid bag transport system, comprising:

a package for transport of a water-soluble film bag having two edge seams and containing gel or liquid, comprising a base and four side walls defining a compartment, the edge of sold side walls having a perimeter rim which defines an opening for receiving a water-soluble film bag within the compartment, wherein the base contains a raised base frame including a plurality of unraised base surface portions and the four side walls each have a centrally disposed raised side surface portion which extends from the perimeter rim to the raised base frame such that said raised base frame and said raised side surface portions are capable of deflecting shock waves generated in the bag during transport thereof;

a water-soluble film bag having two edge seams and containing gel or liquid disposed in said package; and a cover which is heat-sealed to the perimeter rim of the package.

7. The transport system of claim 6, wherein the cover is a polymeric film.

8. The transport system of claim 7, wherein the polymeric film is polyester.

9. A multiple gel or liquid bag transport system, comprising:

at least one pair of gel or liquid bag transport systems comprising:

a package for transport of a water-soluble film bag having two edge seams and containing gel or liquid, comprising a base and four side walls defining a compartment, the edge of said side walls having a perimeter rim which defines an opening for receiving a water-soluble film bag within the compartment, wherein the base contains a raised base frame including a plurality of unraised base surface portions and the four side walls each have a centrally disposed raised side surface portion which extends from the perimeter rim to the raised base frame such that said raised base frame and said raised side surface portions are capable of deflecting shock waves generated in the bag during transport thereof:

a water-soluble film bag having two edge seams and containing gel or liquid disposed in said package; and a cover which is heat-sealed to the perimeter rim of the package;

wherein each pair of systems are secured together by locking means such that the covers in each are adjacent, and wherein any additional pairs are placed adjacent to the other pairs such that the covers for the first systems in each pair are planar and contiguous to each other and the covers for the second systems in each pair are also planar and contiguous to each other.

10. The multiple gel or liquid bag transport system of claim 9, wherein the locking means are male and female members present on the perimeter rim of each package which interlock with the female and male members, respectively, of the other package in the pair.

11. The multiple gel or liquid bag transport system of claim 9, further comprising an outer sleeve for facilitating transport of the system.

12. The multiple gel or liquid bag transport system of claim 11, wherein the outer sleeve is made of cardboard or corrugated board and contains two holes which allow a user to lift the system with one hand.

* * * * *